US005762531A

United States Patent [19]

Witkin

[11] Patent Number: 5,762,531

[45] Date of Patent: Jun. 9, 1998

[54] POSABLE TOY ANIMAL

[76] Inventor: Robert L. Witkin, 511 Burlington Rd., Freehold, N.J. 07728

[21] Appl. No.: 850,251

[22] Filed: May 5, 1997

[51] Int. Cl.[6] ..... A63H 3/02; A63H 3/04

[52] U.S. Cl. ..... 446/374; 446/370

[58] Field of Search ..... 446/374, 373, 446/370, 371, 369, 382, 390

[56] References Cited

U.S. PATENT DOCUMENTS 2,044,949 6/1936 Levy et al. .

2,073,723 3/1937 Woolnough ..... 446/370

2,206,950 7/1940 Gregg ..... 446/374

4,816,002 3/1989 Brodrib ..... 446/374

*Primary Examiner*—Robert A. Hafer

*Assistant Examiner*—D. Neal Muir

*Attorney, Agent, or Firm*—Myron Amer PC

[57] ABSTRACT

A stuffed toy animal using hand-bendable ⅜ inch flat bands to internally support bulk material about the body location of the toy animal and within an outer fabric cover, and using only the bands in depending appendages, such as legs, of the toy animal since the band width effectively simulates the appearance of legs and requires no bulk padding, to thereby significant, reduce manufacturing costs.

1 Claim, 1 Drawing Sheet

POSABLE TOY ANIMAL

The present invention relates generally to posable toy animals, and more particularly to an internal support of metal construction material for the toy animal which is hand-bendable into a selected shape that is retained until bent into another shape, thereby contributing to embodying the toy animal with posing play value.

EXAMPLE OF THE PRIOR ART

Temporary shape-retaining or posable toy animals are well known and are the subject of numerous patents, one of which is U.S. Pat. No. 2,044,949 issued to J. E. Levy et al. for "Method of Making Animal Figures From Tuft Yarn Balls" on Jun. 23, 1936. The temporary shape is provided by an internal animal-shaped wire configuration which firstly is readily hand-bendable into a desired selected pose, and secondly serves as internal support for tufting, wadding or similar bulk-providing materials that provide the appropriate external appearance to the toy animal. In all known internal supports it consists, as noted, of wire of small diameter so as to be readily band-bendable by the child, and effectively serves the play value end purpose intended. However, the wire support must be entirely padded, i.e. along the wire length portions corresponding to the locations of the toy animal legs, arms, neck, tail, or whatever is the case, in order to provide the appropriate external appearance, and this adds to the expense of manufacture.

Broadly, it is an object of the present invention to provide a posable "stuffed" toy animal overcoming the foregoing and other shortcomings of the prior art.

More particularly, it is an object to use internal bendable construction material which provides an external appearance appropriate for the toy animal legs and other appendages without cooperating bulk materials, and thus confining the use of bulking materials to the body with attendant manufacturing economies, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
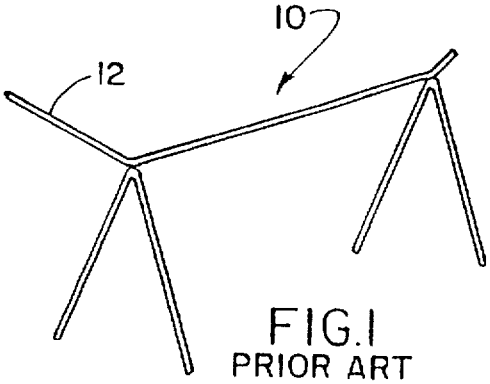
FIG.1 PRIOR ART
FIG. 1 is an isolated perspective view of an internal wire support of a prior art posing stuffed toy animal.
Figure 3:
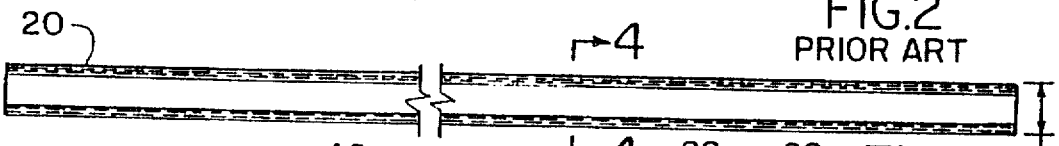
Figure 4:
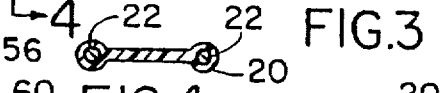
Figure 5:
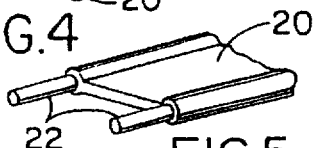
Figure 6:
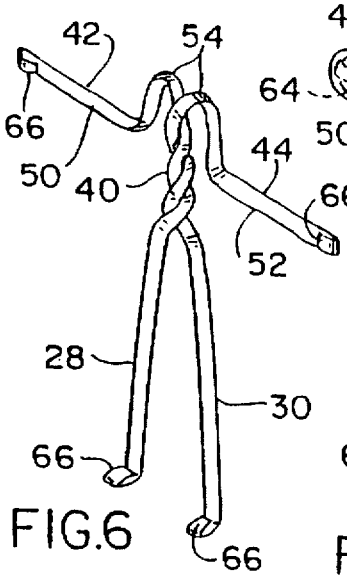
Figure 7:
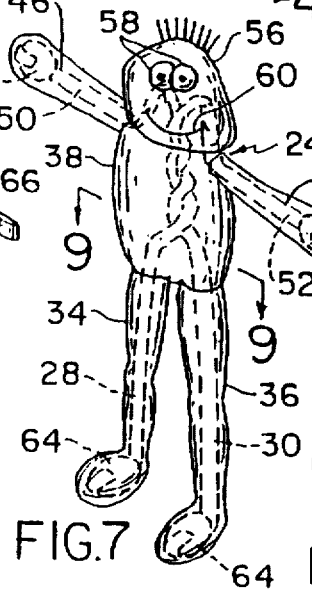
Figure 8:
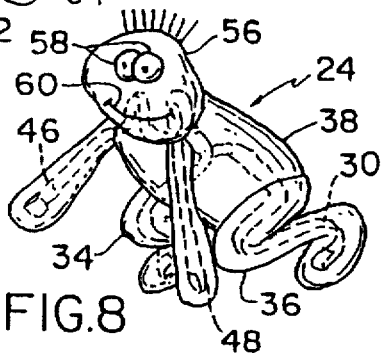
Figure 10:
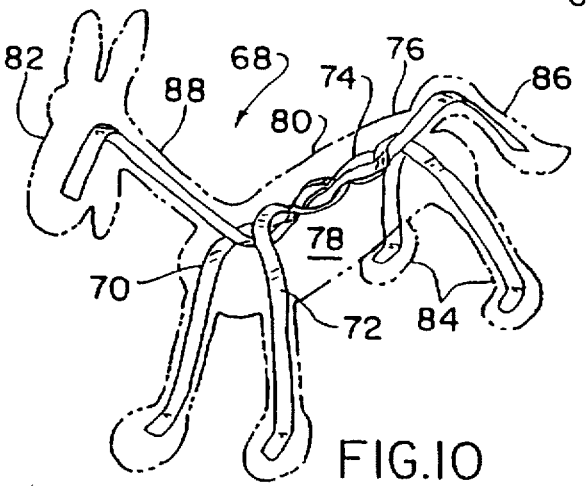
Figure 9:
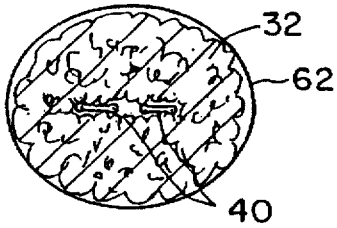

The remaining FIGS. 3–10, inclusive, illustrate aspects of the within inventive improved posing stuffed toy animal, in which FIG. 6, like FIG. 1, is an isolated perspective view of an internal metal band support for the posing stuffed toy animal;

FIG. 4 is a cross sectional view of the metal band as taken along line 4—4 of FIG. 3;

FIG. 5 is a perspective view of the metal band component with exposed wire edges;

FIG. 6 is an isolated perspective view of the metal bands in an initial stage in the construction of the toy animal;

FIG. 7 is a perspective view of an external frog-replicating covering over the metal bands of FIG. 5 which completes the construction of a posing stuffed toy animal according to the present invention;

FIG. 8 is a perspective view of the toy animal of FIG. 7 in a posed position;

FIG. 9 is a cross sectional view, as taken along line 9—9, of FIG. 7 illustrating further structural details; and FIG. 10 is a perspective view of another posing toy animal, specifically in a zebra configuration, using the metal bands for legs and also a neck and tail support in accordance with the present invention.

Figure 2:
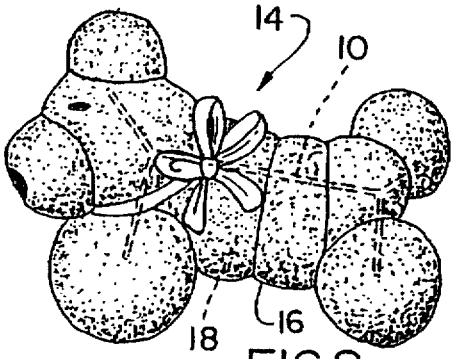
FIG.2 PRIOR ART
FIG. 2 is a perspective view of the external covering over the wire support which completes the construction of the prior art posing stuffed toy animal.

The play value of a posable stuffed toy animal is already well known, being exemplified by the prior art showings in FIGS. 1 and 2 of U.S. Pat. No. 2,044,949, in which an internal wire component 10 consisting of small diameter length portions, individually and collectively designated 12, simulating the legs, body and neck of a toy animal, in this instance a dog 14, are of a construction material that is easily bent by hand into a shape providing a pose to the dog 14 that is retained until the shapes of the wire lengths 12 are changed, the construction of the dog 14 as a commercial article of manufacture being completed by an external cloth covering 16 having an appearance of a dog and held in a dog shape by wadding 18 or similar material typically used for stuffing a toy, which is disposed about the wire component 10 beneath the cloth covering 16.

Underlying the present invention is the recognition that the internal support for the external shape of the posable toy animal can, without wadding, provide a body-simulating appearance, especially that of the legs of the toy animal by using to advantage the depending relation of the legs from the body of toy animal, thereby greatly simplifying the construction of the toy animal, all as will be explained in connection with FIGS. 3–10.

Instead of a small diameter wire 12, the within inventive toy animal uses as an internal support an essentially flat band 20 with reinforced edges of wire 22 of a construction material that is also readily bent by hand into selected shapes providing posing configurations to the toy animal, in this described illustration being in the form that would be perceived to simulate a frog 24, in which the band 20 is of a width 26 that is not less than ⅜ of an inch, it having been found in practice that the width attribute of the band obviates the need to wrap the leg-simulating length portions 28 and 30 with any wadding 32 in order to provide leg appearances to the length portions 28 and 30, this perception of leg appearances also being undoubtedly a consequence of the depending relation of the legs 34 and 36 from the toy animal body 38, as one expects as between a body and legs.

A preliminary step in the construction of the stuffed toy frog 24 is the twisting together, as at 40, of two lengths 42 and 44 of the band construction material 20 providing what will be the internal support for arms 46 and 48, and depending legs 34 and 36. As best understood from FIG. 9, next, an appropriate wadding 32 such as cotton or the like, is wrapped about the twists 40, and thus at a first location which coincides with the body 38 of the frog 24 but not about the leg length portions 28 and 30 or about the arm length portions 50 and 52, but is confined in addition to the body location 38 to another location, as at 54, which coincides with the simulated head 56 of the frog 24 and so identified by simulated eyes 58 and a mouth 60, and in this manner the confined locations 40 and 54 of the wadding 32 significantly simplify the construction of the frog 24, said construction being completed by an external cloth covering 62 disposed in a wrapped condition over the wadding 32 and the exposed leg and arm band length portions 28, 30, 50 and 52.

Optionally, tufts of wadding 64 can be held in place under reverse bands, individually and collectively designated 66, at the free ends of the band length portions 28, 30, 50 and 52 to add bulk which more realistically simulates hands and feet. The resulting toy frog 24 is readily placed in selected poses, as demonstrated in FIG. 8.

In the toy animal-replicating construction of FIG. 10, the selected animal is a perceived giraffe 68 using the noted ⅜ of an inch metal bands 70 and 72 twisted at a body location, as at 74, and using, beneath a cloth covering 76, a wadding 78 in the body and head locations 80 and 82 respectively, thereby simplifying the construction of the giraffe 68 by the omission of wadding not only in the four legs 84, in the tail 86, but also in the typical long neck 88 of this animal shape.

While the toy animal herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. Improvements for an animal-replicating construction of a type having a body and at least two legs in depending relation from said body each leg having an internal support of selected construction material bendable into retained shapes, said improvements embodied by said animal-replicating construction comprising a body means having an outer fabric cover bounding an internal compartment, a pliable bulk material positioned in said compartment to impart internal support for said body outer fabric cover in an animal-replicating shape, at least two leg-simulating fabric means of a tubular configuration each bounding a leg-positioning compartment connected to extend from said body outer fabric cover, and disposed in each said leg-positioning compartment a flat band of a width not less than ⅜ of an inch and having an operative position disposed in said leg-positioning compartment having a width slightly in excess of said width of said band, said band being of bendable metal construction material serving as said each internal leg support for a leg and extending in depending relation from said body means, said undersized width of not greater than ⅜ inch of said band and said oversized width in excess of ⅜ inch of said leg-positioning compartment bound a clearance therebetween devoid of any said pliable bulk material, whereby said width of said bands contribute to an animal-replicating leg shape obviating the need for the use of any pliable bulk material in said leg-positioning compartments.

* * * * *